US011440327B2

(12) United States Patent
Sugiura

(10) Patent No.: US 11,440,327 B2
(45) Date of Patent: Sep. 13, 2022

(54) LIQUID EJECTION DEVICE INCLUDING CARTRIDGE ATTACHMENT PORTION AND SHEET ROLL HOLDER POSITIONED AT FRONT PORTION OF CASING

(71) Applicant: BROTHER KOGYO KABUSHIKI KAISHA, Nagoya (JP)

(72) Inventor: Keita Sugiura, Toyokawa (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/190,282

(22) Filed: Mar. 2, 2021

(65) Prior Publication Data

US 2021/0291535 A1 Sep. 23, 2021

(30) Foreign Application Priority Data

Mar. 23, 2020 (JP) ..... JP2020-050455

(51) Int. Cl.

| | |
|---|---|
| ***B41J 2/175*** | (2006.01) |
| ***B41J 2/045*** | (2006.01) |
| ***B41J 2/17*** | (2006.01) |
| ***B41J 2/185*** | (2006.01) |

(52) U.S. Cl.

CPC ..... *B41J 2/1752* (2013.01); *B41J 2/04548* (2013.01); *B41J 2/1721* (2013.01); *B41J 2/185* (2013.01); *B41J 2002/1853* (2013.01)

(58) Field of Classification Search

CPC ..... B41J 2/04548; B41J 2/1721; B41J 2/175; B41J 2/17509; B41J 2/1752; B41J 2/185; B41J 2002/1853; B41J 29/02; B41J 29/13

See application file for complete search history.

(56) References Cited

U.S. PATENT DOCUMENTS 5,430,468 A * 7/1995 Sasai ..... B41J 11/42 400/636
2013/0120489 A1* 5/2013 Ito ..... B41J 2/16526 428/32.1
2015/0266298 A1* 9/2015 Kifuku ..... B41J 2/16526 347/9

FOREIGN PATENT DOCUMENTS

JP 2015-120587 A 7/2015

* cited by examiner

*Primary Examiner* — Anh T Vo
(74) *Attorney, Agent, or Firm* — Kenealy Vaidya LLP

(57) ABSTRACT

A liquid ejection device includes: a casing; a holder for rotatably supporting a sheet roll including a continuous sheet; a power transmission mechanism positioned beside the holder for transmitting rotational driving force thereto; a cartridge attachment portion positioned above the power transmission mechanism; a conveying mechanism for conveying the continuous sheet to a discharge opening of the casing; and a head for ejecting liquid to the continuous sheet. The holder supporting the sheet roll is rotatable about a rotation axis extending in a leftward/rightward direction. A cartridge is attachable to the cartridge attachment portion. An occupying range of the cartridge attachment portion is overlapped with an occupying range of the power transmission mechanism and outside of an occupying range of the sheet roll and the holder in the leftward/rightward direction. The holder and the cartridge are attachable to and detachable from the casing through an opening thereof.

21 Claims, 9 Drawing Sheets

LIQUID EJECTION DEVICE INCLUDING CARTRIDGE ATTACHMENT PORTION AND SHEET ROLL HOLDER POSITIONED AT FRONT PORTION OF CASING

CROSS REFERENCE TO RELATED APPLICATION

This application claims priority from Japanese Patent Application No. 2020-050455 filed Mar. 23, 2020. The entire content of the priority application is incorporated herein by reference.

TECHNICAL FIELD

The present disclosure relates to a liquid ejection device configured to eject liquid on a rolled continuous sheet.

BACKGROUND

As a liquid ejection device configured to eject liquid on a continuous sheet paid out of a sheet roll, there has been known a label printer for recording an image by ejecting ink on a label and a card. In the label printer, a sheet roll and a cartridge storing ink are replaceable with a new sheet roll and a new cartridge, respectively.

For example, in a printer disclosed in Japanese Patent Application Publication No. 2015-120587, a holder for supporting a sheet roll is positioned at a rear portion of the printer, and a cartridge is positioned at a front portion of the printer. A drive mechanism for driving the holder is also positioned at the rear portion of the printer. Hence, mechanical interference between the cartridge and the drive mechanism does not occur in a structure where the cartridge and the drive mechanism are positioned at an even vertical level. Accordingly, the resultant printer can have a reduced widthwise dimension.

SUMMARY

However, the holder for supporting the sheet roll may be positioned at the front portion of the printer, so that the sheet roll is accessible to a user from a front side of the printer for exchanging the sheet roll in addition to the exchange of the cartridge. In this case, the drive mechanism for driving the holder must be also positioned at the front portion of the printer. Accordingly, mechanical interference may occur between the cartridge and the drive mechanism if the cartridge and the drive mechanism are to be positioned at the same level as each other.

In order to avoid the interference, the cartridge and the drive mechanism have to be positioned side by side in a widthwise direction. However, the resultant printer may have an increased widthwise dimension.

In view of the foregoing, it is an object of the disclosure to provide a liquid ejection device capable of avoiding an increase in widthwise dimension thereof, with a sheet roll and a cartridge arranged at a front portion of the device to allow a user to access the cartridge and the sheet roll from a front side of the device.

In order to attain the above and other objects, according to one aspect, the disclosure provides a liquid ejection device including a casing, a holder, a power transmission mechanism, a cartridge attachment portion, a conveying mechanism, and a head. The casing has a front surface in which a discharge opening and an opening are formed. The casing defines therein an internal space. The holder is configured to be accommodated in the internal space and is configured to rotatably support a sheet roll including a continuous sheet. The holder supporting the sheet roll is rotatable about a rotation axis extending in a leftward/rightward direction perpendicular to a frontward/rearward direction and an upward/downward direction. The power transmission mechanism is positioned beside the holder in the leftward/rightward direction and is configured to transmit rotational driving force to the holder. The cartridge attachment portion is positioned above the power transmission mechanism and is configured to receive a cartridge storing liquid therein. The conveying mechanism is positioned in the internal space and is configured to convey the continuous sheet to the discharge opening. The head is positioned in the internal space and is configured to eject the liquid to the continuous sheet. An occupying range of the cartridge attachment portion is overlapped with an occupying range of the power transmission mechanism and is outside of an occupying range of the sheet roll and the holder in the leftward/rightward direction. The cartridge and the holder are attachable to and detachable from the casing through the opening.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1:
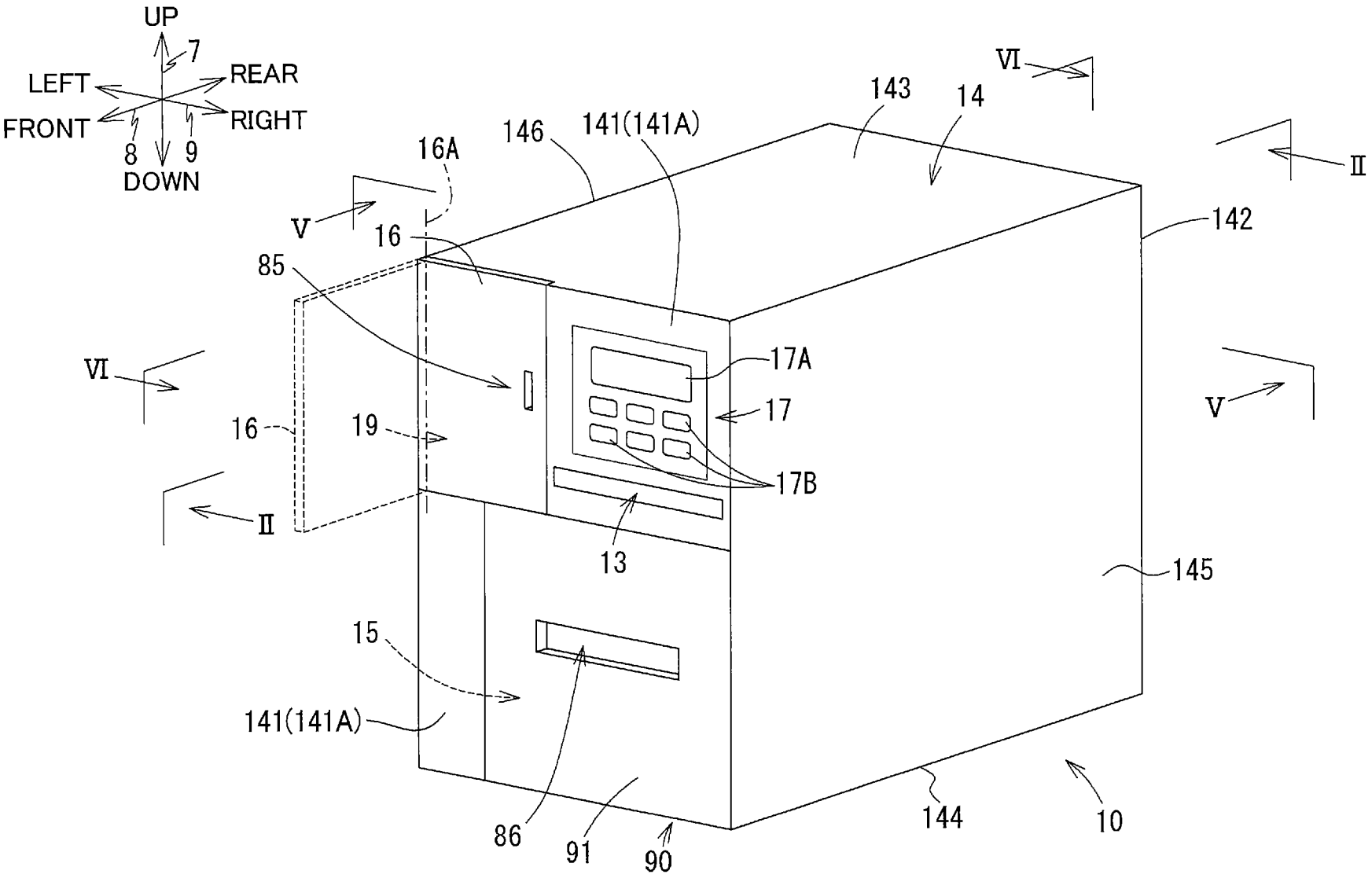
FIG. 1 is a perspective view of a printer 10 according to one embodiment.

Hereinafter, a printer 10 as an example of a liquid ejection device according to one embodiment of the present disclosure will be described with reference to the accompanying drawings.

In the following description, directions with regard to the printer 10 (frontward direction, rearward direction, upward direction, downward direction, leftward direction, and rightward direction) will be referred to based on arrows indicated in the drawings. Incidentally, bi-directions indicated by arrows in two opposite directions (a frontward/rearward direction 8, an upward/downward direction 7, and a leftward/rightward direction 9) will be used to mean the two opposite directions may be interchangeable with each other in interpretation of the disclosure.

More specifically, the upward/downward direction 7 is defined on a basis of an orientation of the printer 10 illustrated in FIG. 1 (in which the printer 10 is intended to be used). The frontward/rearward direction 8 is defined on a basis of the orientation of the printer 10 where a discharge opening 13 (described later) is at a front side of the printer 10. The leftward/rightward direction 9 is defined on a basis of the orientation of the printer 10 when the printer 10 is viewed from the front side thereof. The upward/downward direction 7, the frontward/rearward direction 8, and the leftward/rightward direction 9 are perpendicular to each other.

[External Structure of the Printer 10]

Figure 2:
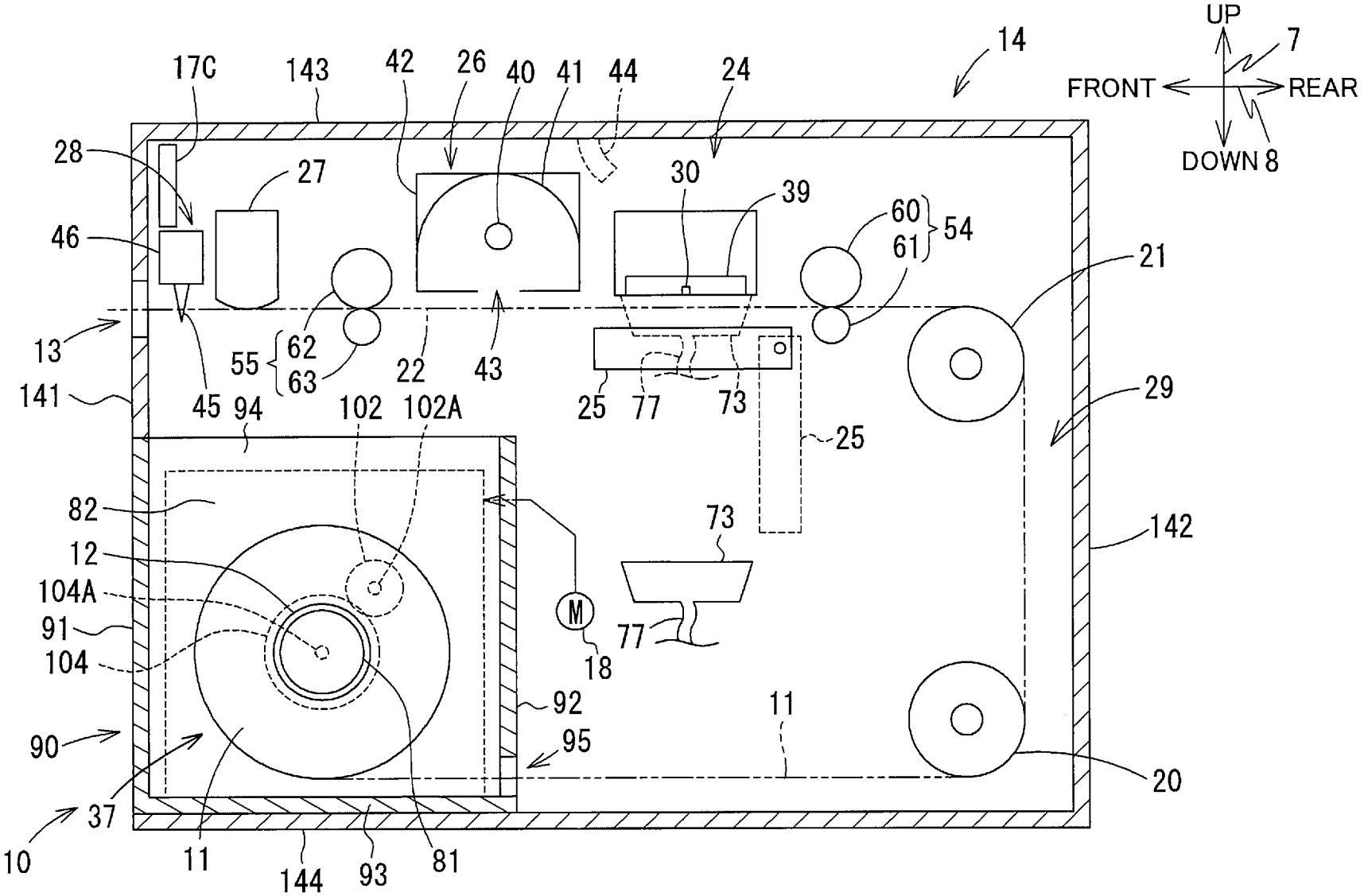
FIG. 2 is a cross-sectional side view of the printer 10 taken along a line II-II in FIG. 1.

As illustrated in FIG. 1, the printer 10 is an ink jet recording type printer configured to record an image on a sheet 11 (see FIG. 2).

The printer 10 includes a casing 14 having a shape of generally rectangular parallelepiped.

The casing 14 includes a front wall 141, a rear wall 142, an upper wall 143, a lower wall 144, a right wall 145, and a left wall 146. These walls in combination define therein an internal space 29 (see FIG. 2) of the casing 14. The right wall 145 and the left wall 146 are positioned away from each other in the leftward/rightward direction 9. The upper wall 143 connects an upper end of the right wall 145 to an upper end of the left wall 146. The lower wall 144 connects a lower end of the right wall 145 to a lower end of the casing 14. The front wall 141 and the rear wall 142 are positioned away from each other in the frontward/rearward direction 8. The discharge opening 13 is open at a front surface 141A of the front wall 141. The discharge opening 13 is positioned at a right portion of the front wall 141. The casing 14 has a size stable for being placed on a table for use. That is, the printer 10 is available as a desktop printer. The printer 10 may also be placed on a floor for use.

An operation panel 17 is positioned on the front wall 141 at a position above the discharge opening 13. The operation panel 17 includes a display screen 17A, input keys 17B, and a circuit board 17C (FIG. 2). The display screen 17A and the input keys 17B are exposed to an outside on the front surface 141A of the front wall 141. The circuit board 17C is positioned rearward of the display screen 17A and the input keys 17B, and is connected to the display screen 17A and the input keys 17B. The circuit board 17C is not exposed to the outside. The operation panel 17 is configured to be operated by a user to perform various settings and operate the printer 10.

A first opening 15 is open at a lower portion of the front surface 141A of the front wall 141 at a position below the discharge opening 13 and the operation panel 17. A second opening 19 is open at a left portion of the front surface 141A at a position leftward of the discharge opening 13 and the operation panel 17. In the present embodiment, the first opening 15 and the second opening 19 are continuous with each other. However, the first and second openings 15 and 19 may be discrete openings in separation from each other.

Below the discharge opening 13, a front wall 91 of a holder attachment portion 90 (described later) is positioned. The front wall 91 closes the first opening 15. The front wall 91 constitutes a part of the front wall 141 of the casing 14. Incidentally, the first opening 15 is opened by user's pulling of the holder attachment portion 90 frontward.

A cover 16 is positioned leftward of the discharge opening 13 and the operation panel 17. The cover 16 is pivotally movable about a pivot axis 16A positioned at a left end portion thereof between a closed position illustrated in FIG. 1 and an open position illustrated in FIG. 3. The cover 16 has a recessed portion 85 for a user's access for opening and closing the cover 16. The cover 16 closes the second opening 19 when the cover 16 is at the closed position. The cover 16 at its closed position constitutes a part of the front wall 141 of the casing 14. The second opening 19 is opened by pivotally moving the cover 16 at the closed position to the open position, so that the internal space 29 of the casing 14 is exposed to the outside.

Rearward of the cover 16 provided are a cartridge attachment portion 110, cartridges 70, and a waste liquid tank 71 (see FIG. 5) those described later. The internal space 29 of the casing 14 is shut off from the outside as a result of the pivotal movement of the cover 16 to the closed position. Incidentally, in FIG. 3, components that are positioned in the internal space 29 and that are visible through the second opening 19 (such as the cartridge attachment portion 110, the cartridges 70 and the waste liquid tank 71) are not illustrated.

Figure 4:
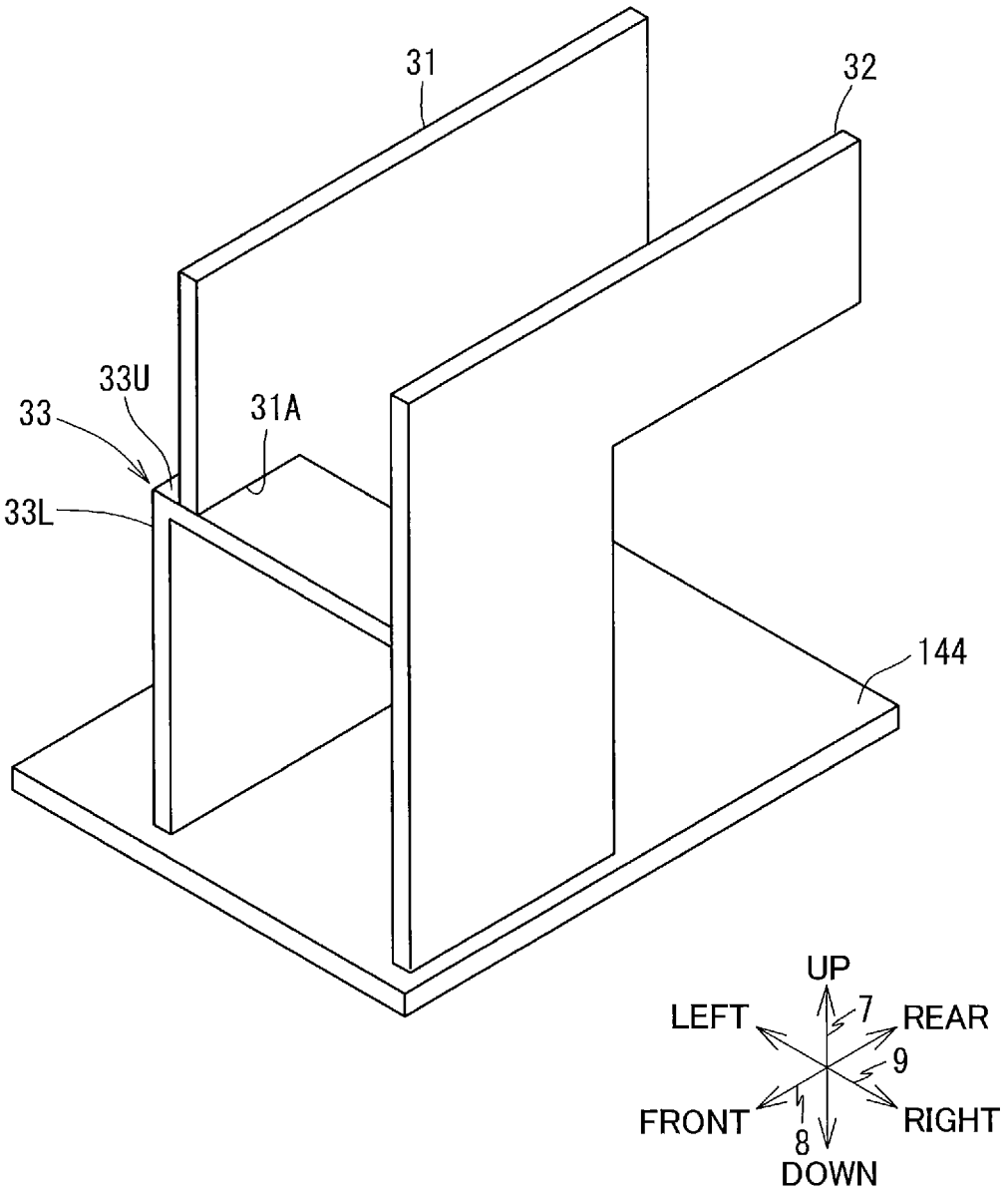
FIG. 4 is a perspective view of a left side frame 31, a right side frame 32, and a sub-frame 33 those connected to a lower wall 144 of the casing 14 in the printer 10 according to the embodiment.
Figure 5:
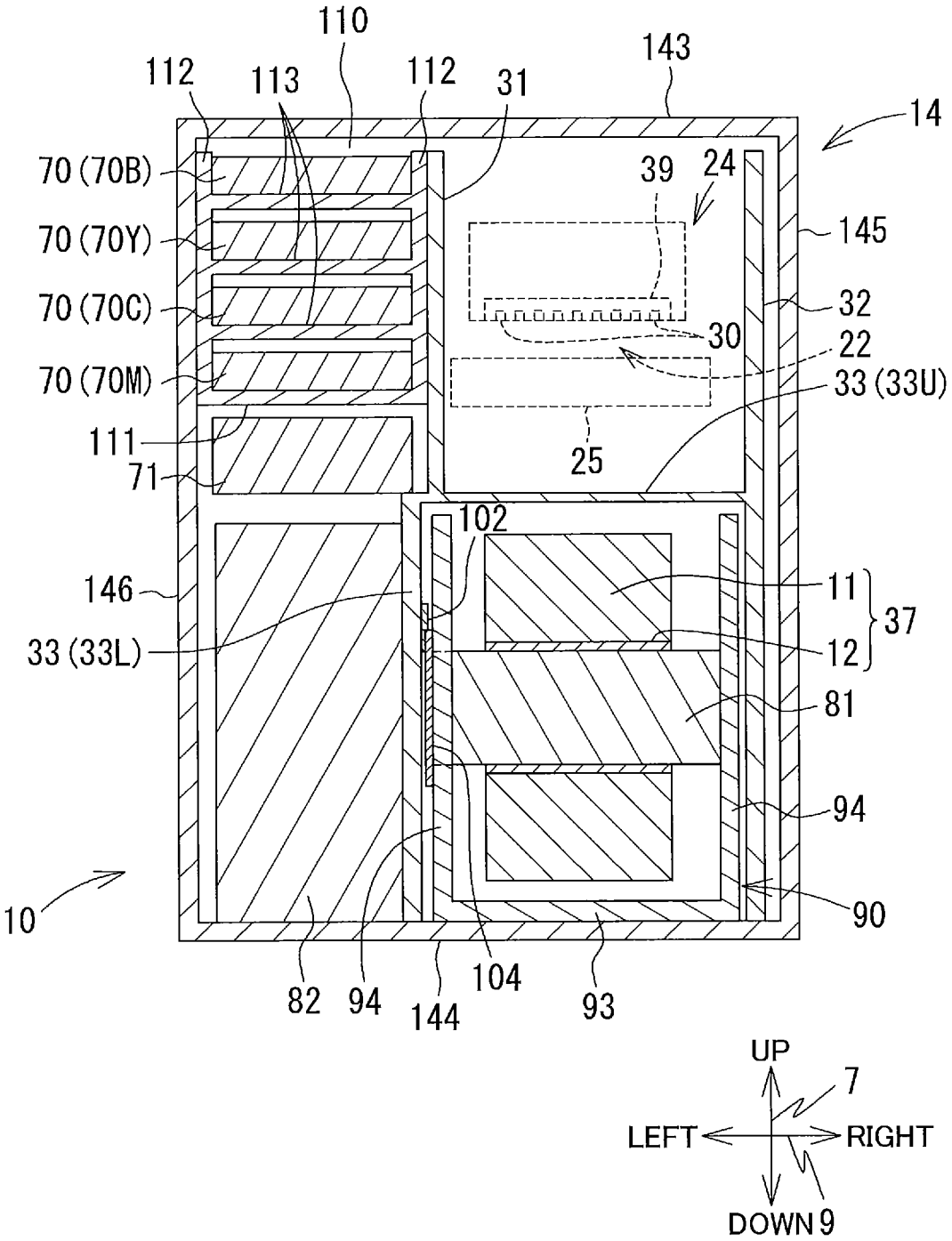
FIG. 5 is a cross-sectional view of the printer 10 taken along a line V-V in FIG. 1.

As illustrated in FIGS. 4 and 5, a left side frame 31, a right side frame 32, and a sub-frame 33 are positioned in the internal space 29 of the casing 14. Each of the side frames 31 and 32 has a flat plate-like shape and is made from steel. Each of the side frames 31 and 32 has notch(es) and through-hole(s) each in conformance with a member to be supported by these side frames 31, 32, as well as bent portion(s) to increase strength, as appropriate. The left side frame 31 and right side frame 32 are positioned away from each other in the leftward/rightward direction 9. Incidentally, the left side frame 31 and right side frame 32 are connected together by another frame (not illustrated) constituting an integral frame structure which is connected to the lower wall 144 of the casing 14. The side frames 31, 32 and the other frame are connected together by screws or welding.

The left side frame 31 has a front lower end portion formed with a notch 31A. Therefore, the front end portion of the left side frame 31 is not connected to the lower wall 144, but has a space corresponding to the notch 31A. The sub-frame 33 is provided at the notch 31A.

The sub-frame 33 has an L-shape including an upper wall 33U and a left wall 33L. The left wall 33L and the right side frame 32 are spaced apart from each other in the leftward/rightward direction 9. The upper wall 33U connects an upper end of the left wall 33L to the right side frame 32. The left wall 33L has a lower end connected to the lower wall 144 of the casing 14. The upper wall 33U is connected to the notch 31A of the left side frame 31. Hence, the sub-frame 33 is positioned below the front portion of the left side frame 31, and constitutes an integral frame structure together with the left side frame 31 and right side frame 32. The right side frame 32 and the sub-frame 33 define a space therebetween for accommodating a sheet roll 37 and a holder 81 (see FIG. 5).

[Internal Structure of the Printer 10]

As illustrated in FIGS. 2 and 5, a sheet passage 22 is formed at a right portion of the internal space 29 of the casing 14. In the right portion of the internal space 29, provided are the sheet roll 37, the holder 81, a first sheet feed roller 20, a second sheet feed roller 21, a first pair of conveyer rollers 54, a second pair of conveyer rollers 55, a recording unit 24 including a head 39, a platen 25, a cap 73, a heater 26, a contact image center (CIS) 27, and a cutter unit 28.

Figure 6:
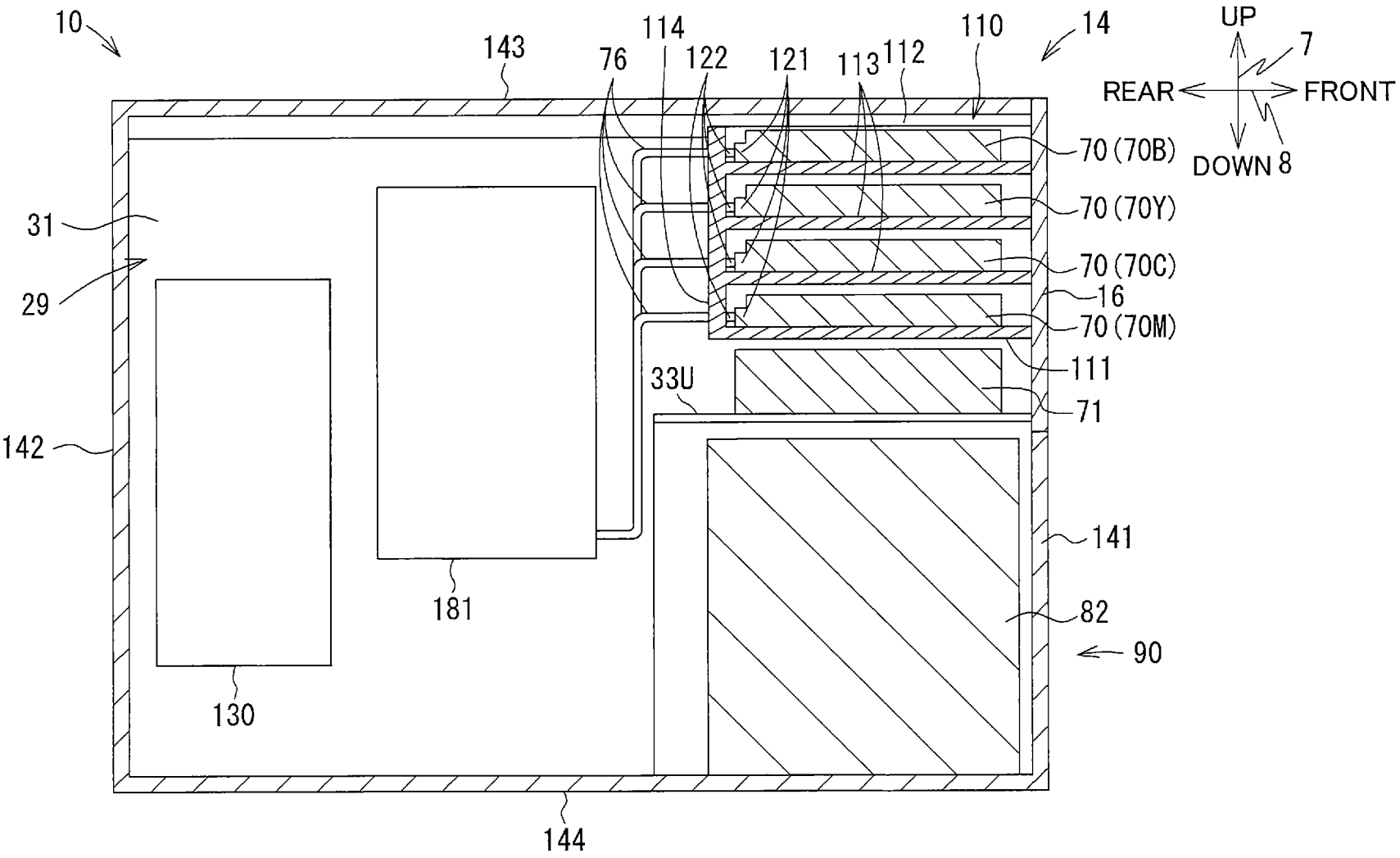
FIG. 6 is a cross-sectional view of the printer 10 taken along a line VI-VI in FIG. 1.

As illustrated in FIGS. 5 and 6, in a left portion of the internal space 29 of the casing 14, provided are a power transmission mechanism 82, the cartridge attachment portion 110, the cartridges 70, and the waste liquid tank 71.

Among the components provided in the right portion of the internal space 29, the second sheet feed roller 21, the first pair of conveyer rollers 54, the second pair of conveyer rollers 55, the recording unit 24 including the head 39, the platen 25, the cap 73, the heater 26, the CIS 27, and the cutter unit 28 are positioned in the space defined between the left side frame 31 and the right side frame 32 and above the upper wall 33U of the sub-frame 33. Incidentally, in FIG. 5, for simplification, only the recording unit 24 and the platen 25 are illustrated in broken lines to indicate layout thereof.

Among the components positioned in the left portion of the internal space 29, the cartridge attachment portion 110, the cartridges 70, and the waste liquid tank 71 are positioned leftward of the left side frame 31, and above the sub-frame 33.

The sheet roll 37 and the holder 81 are positioned inside the holder attachment portion 90. The holder attachment portion 90 is positioned in the right portion of the internal space 29, when attached to the casing 14. Specifically, the holder attachment portion 90 is positioned in a space defined by the right side frame 32, the upper wall 33U, and the left wall 33L of the sub-frame 33. The holder attachment portion 90 is positioned in a front portion of the internal space 29. However, the holder attachment portion 90 may be positioned at a rear portion of the internal space 29. Alternatively, the holder attachment portion 90 may be positioned across the front portion and the rear portion of the internal space 29.

Figure 3:
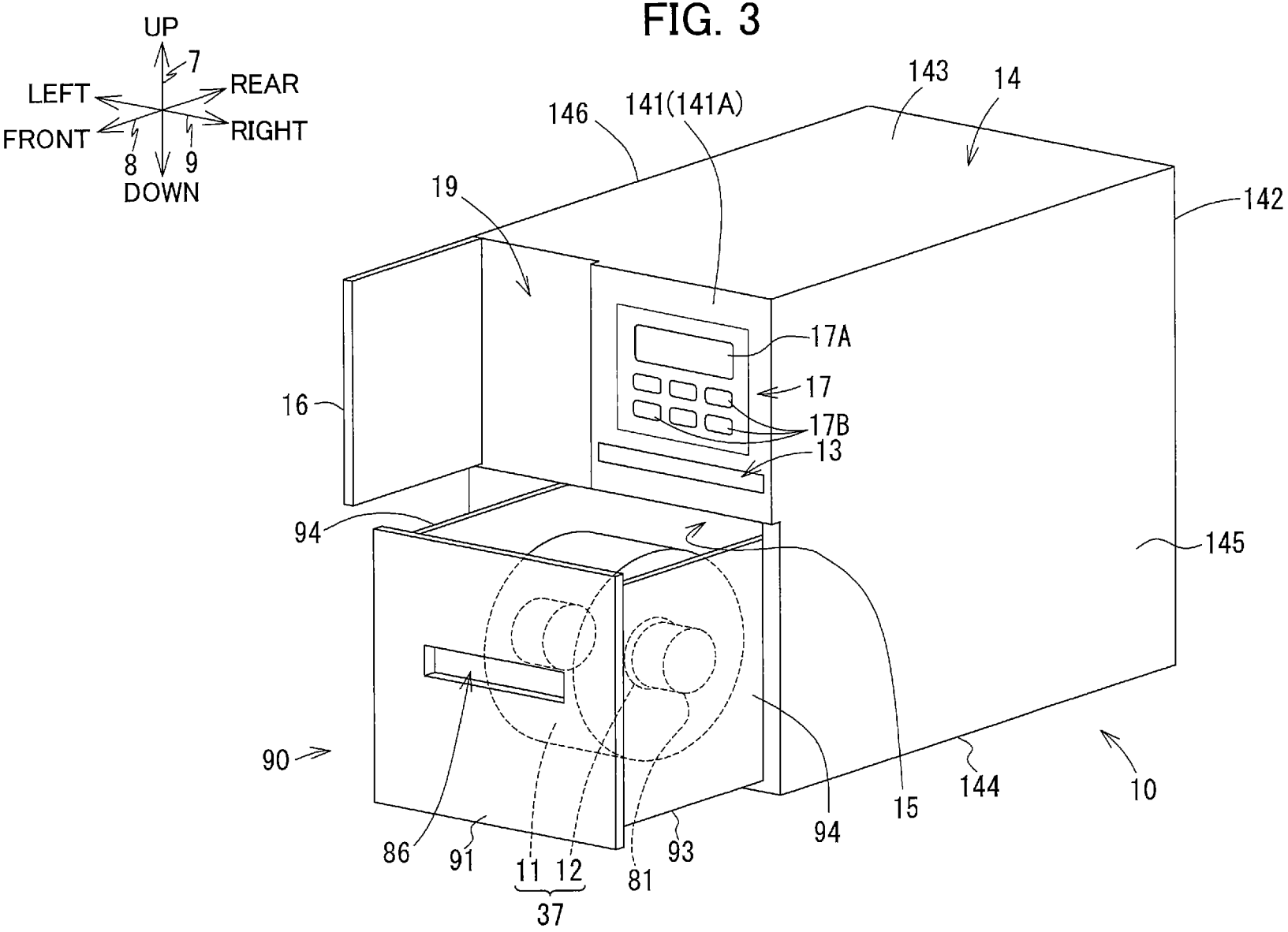
FIG. 3 is a perspective view of the printer 10 according to the embodiment and illustrating a state where a holder attachment portion 90 is pulled out frontward from a casing 14.

As illustrated in FIG. 3, the holder attachment portion 90 has a box-like shape that is open upward. As illustrated in FIGS. 2 and 3, the holder attachment portion 90 includes the front wall 91, a rear wall 92, a bottom wall 93, and a pair of side walls 94. The bottom wall 93 is supported by the lower wall 144 of the casing 14, when the holder attachment portion 90 is attached to the casing 14. The front wall 91 extends upward from a front end of the bottom wall 93. The rear wall 92 extends upward from a rear end of the bottom wall 93. The pair of side walls 94 extend upward from right and left ends of the bottom wall 93.

As illustrated in FIG. 2, the rear wall 92 has a lower portion formed with an opening 95. As will be described later, the sheet 11 is configured to be paid out from the sheet roll 37 toward the rear of the holder attachment portion 90 through the opening 95.

As illustrated in FIGS. 2, 3 and 5, the sheet roll 37 and the holder 81 are arranged in the holder attachment portion 90.

The holder attachment portion 90 is supported by the casing 14 so as to be movable in the frontward/rearward direction 8 relative to the casing 14. As illustrated in FIG. 1, the front wall 91 has a front surface formed with a recessed portion 86 as a finger-held portion. The holder attachment portion 90 is moved frontward relative to the casing 14 as illustrated in FIG. 3 when a user hooks his finger on the recessed portion 86 and pulls the holder attachment portion 90 frontward. Incidentally, instead of the recessed portion 86, a protruding portion is available as the finger-held portion.

In a state of FIG. 3 where the holder attachment portion 90 is pulled out forward relative to the casing 14, the first opening 15 is opened so that an interior of the holder attachment portion 90 is exposed to the outside. That is, the sheet roll 37 and the holder 81 are exposed to the outside.

When the holder attachment portion 90 is pushed rearward from the state illustrated in FIG. 3, the holder attachment portion 90 is accommodated in the casing 14 as illustrated in FIG. 1. At this time, the holder attachment portion 90 is positioned in the space defined by the right side frame 32, the upper wall 33U, and the left wall 33L of the sub-frame 33, as illustrated in FIG. 5.

Further, in the state where the holder attachment portion 90 is accommodated in the casing 14, the interior of the holder attachment portion 90 is shut off from the outside; and the front wall 91 of the holder attachment portion 90 constitutes the part of the front wall 141 of the casing 14. That is, a front portion of the holder attachment portion 90 is positioned adjacent to the first opening 15.

As illustrated in FIG. 5, the holder 81 is a rod-like member. The holder 81 has a longitudinal end portion provided with a follower gear 104. The holder 81 is rotatable about its axis extending in its longitudinal direction (i.e., in the leftward/rightward direction 9). The follower gear 104 is coaxial with and integrally rotatable with the holder 81. The follower gear 104 includes a rotation shaft 104A (FIG. 2).

The holder 81 is attachable to and detachable from the holder attachment portion 90 in a state where the holder attachment portion 90 is pulled out frontward relative to the casing 14. Each side wall 94 of the holder attachment portion 90 is formed with a notch (not illustrated) that is recessed downward from an upper end of each side wall 94. The holder 81 is fitted with the respective notches to be attached to the holder attachment portion 90. Specifically, the left end portion of the holder 81 in its axial direction where the follower gear 104 is attached is fitted with the notch formed in the left side wall 94, and the right end portion of the holder 81 is fitted with the notch formed in the right side wall 94. The holder 81 attached to the holder attachment portion 90 extends in the leftward/rightward direction 9, such that the holder 81 is rotatable about its axis extending in the leftward/rightward direction 9. Further, the holder 81 attached to the holder attachment portion 90 is positioned rightward of the left side frame 31 in the state where the holder attachment portion 90 is accommodated in the casing 14. That is, the holder 81 is positioned generally between the left side frame 31 and the right side frame 32.

As illustrated in FIGS. 2, 3 and 5, the sheet roll 37 includes a core tube 12 and the continuous elongated sheet 11 wound over the core tube 12 in a rolled manner. The sheet roll 37 is attached to the holder 81 by insertion of the holder 81 in the core tube 12. As a result of attachment of the holder 81 supporting the sheet roll 37 to the notches of the side walls 94, the sheet roll 37 is positioned in the interior of the holder attachment portion 90 such that the axis of the sheet roll 37 is oriented in the leftward/rightward direction 9.

A motor 18 is also positioned in the internal space 29 (see FIG. 2). The power transmission mechanism 82 is configured to transmit rotational driving force of the motor 18 to the holder 81. That is, the driving force of the motor 18 is transmitted to the holder 81 through the power transmission mechanism 82. The power transmission mechanism 82 per se has a conventional structure. For example, the power transmission mechanism 82 may include a frame, gears, pulleys, and a belt those supported by the frame. Further, the power transmission mechanism 82 of the present embodiment includes a transmission gear 102.

The components of the power transmission mechanism 82 except the transmission gear 102 is positioned leftward of the left wall 33L of the sub-frame 33, as illustrated in FIG.

5. The power transmission mechanism 82 is positioned beside and leftward of the holder attachment portion 90 such that the left wall 33L is positioned between the power transmission mechanism 82 (except the transmission gear 102) and the holder attachment portion 90. The power transmission mechanism 82 is positioned leftward of the left side frame 31. Incidentally, the power transmission mechanism 82 may be positioned beside and rightward of the holder attachment portion 90. That is, the power transmission mechanism 82 may be positioned beside the holder 81 in the leftward/rightward direction 9.

The transmission gear 102 is positioned rightward of the left wall 33L of the sub-frame 33. The left wall 33L is formed with a through-hole (not illustrated). The transmission gear 102 includes a rotation shaft 102A (FIG. 2) penetrating through the through-hole. That is, the transmission gear 102 is connected to the remaining components of the power transmission mechanism 82 positioned leftward of the left wall 33L by way of the rotation shaft 102A.

In the attached state of the holder attachment portion 90 to the casing 14, the rotation shaft 102A of the transmission gear 102 is positioned rearward of the rotation shaft 104A of the follower gear 104 connected to the holder 81. Hence, the follower gear 104 approaches and meshingly engages the front side of the transmission gear 102 upon attachment of the holder attachment portion 90 to the casing 14. Accordingly, interference of the holder attachment portion 90 with the transmission gear 102 does not occur at the time of attachment and detachment of the holder attachment portion 90 relative to the casing 14.

With the structure, the rotational driving force of the motor 18 is transmitted to the power transmission mechanism 82, and then is transmitted to the holder 81 through the transmission gear 102 and the follower gear 104 of the holder 81. The holder 81 is thus rotatable in response to the rotation of the motor 18. The sheet roll 37 supported by the holder 81 is rotatable in accordance with the rotation of the holder 81.

As illustrated in FIG. 2, the first sheet feed roller 20 is positioned in the internal space 29 of the casing 14. The first sheet feed roller 20 is positioned at a rear lower end portion of the internal space 29. The second sheet feed roller 21 is positioned vertically above the first sheet feed roller 20. The sheet 11 paid out rearward from the sheet roll 37 through the opening 95 moves over the first sheet feed roller 20 and extends upward after moving past the first sheet feed roller 20, and then extends frontward after moving past the second sheet feed roller 21.

The sheet passage 22 linearly extends from the second sheet feed roller 21 to the discharge opening 13 in the frontward/rearward direction 8. The sheet passage 22 is a space allowing the sheet 11 to pass therethrough. The sheet passage 22 is defined by guide members (not illustrated) spaced away from each other in the upward/downward direction 7, the recording unit 24, the platen 25, and the heater 26, and the like. The sheet 11 is configured to be conveyed along the sheet passage 22 in a sheet conveying direction, i.e., frontward.

In the sheet passage 22, the first pair of conveyer rollers 54 is positioned upstream of the recording unit 24 in the sheet conveying direction. The first pair of conveyer rollers 54 includes a first conveyer roller 60 and a first pinch roller 61. In the sheet passage 22, the second pair of conveyer rollers 55 is positioned downstream of the heater 26 in the sheet conveying direction. The second pair of conveyer rollers 55 includes a second conveying roller 62 and a second pinch roller 63. The first conveyer roller 60 and the second conveying roller 62 are rotatable by the transmission of the rotational driving force from the motor 18. The sheet 11 is conveyed toward the discharge opening 13 by the driving rotation of the conveying rollers 60, 62 while the sheet 11 is nipped between each conveying roller 60, 62 and its corresponding pinch roller 61, 63.

In the sheet passage 22, the recording unit 24 including the head 39, the platen 25, and the heater 26 are positioned between the first pair of conveyer rollers 54 and the second pair of conveyer rollers 55.

As illustrated in FIGS. 2 and 5, the platen 25 is positioned below the recording unit 24. An upper surface of the platen 25 is configured to support the sheet 11 being conveyed. Suction openings (not illustrated) are open on the upper surface of the platen 25 to apply negative pressure to the sheet 11 moving over the upper surface of the platen 25, thereby providing close contact of the sheet 11 with the upper surface.

The platen 25 is supported by the left side frame 31 and the right side frame 32 such that the platen 25 is pivotally movable about a pivot shaft between a supporting position (indicated by a solid line in FIG. 2) and a retracted position (indicated by a broken line in FIG. 2). The pivot shaft is positioned at a rear end portion of the platen 25 and extends in the leftward/rightward direction 9. Incidentally, the pivot shaft may be at a position other than the rear end portion of the platen 25, for example, at a front end portion of the platen 25. Further, the platen 25 may be supported by a component other than the side frames 31 and 32.

When the platen 25 is at the supporting position, the platen 25 extends frontward from the pivot shaft, and the upper surface of the platen 25 faces the head 39 at a position below the head 39 to support the sheet 11. The platen 25 extends downward from the pivot shaft and is retracted from the supporting position when the platen 25 is at the retracted position.

The head 39 is positioned rearward of a rear end of the sheet roll 37. In other words, the head 39 is positioned rearward of a region occupied by the sheet roll 37 ("occupying region"). The head 39 has a lower surface formed with a plurality of nozzles 30.

The head 39 is configured to eject ink from the plurality of nozzles 30 to the sheet 11 supported on the platen 25 when the platen 25 is at the supporting position. Hence, an image is formed on the sheet 11 supported on the platen 25.

Further, the head 39 is configured to eject (discharge) ink from the plurality of nozzles 30 to a space in the cap 73 when the platen 25 is at the retracted position and the cap 73 is at a capping position (described later) as indicated by a broken line in FIG. 2. The cap 73 is configured to receive the ink discharged from the head 39.

Ink to be ejected by the head 39 is supplied from each cartridge 70 through a tube 76 (FIG. 6), a circulation mechanism 181 (FIG. 6), and tubes 120 (FIG. 7) each corresponding to the cartridge 70. Each of the cartridges 70 has a generally rectangular parallelepiped shape and defines an internal space therein for storing ink.

As illustrated in FIGS. 5 and 6, the cartridges 70 are attachable to the cartridge attachment portion 110. The cartridge attachment portion 110 is positioned in a front upper left portion of the internal space 29. That is, the cartridge attachment portion 110 is positioned immediately rearward of the cover 16. Further, the cartridge attachment portion 110 is positioned above the power transmission mechanism 82.

As illustrated in FIG. 5, the cartridge attachment portion 110 has its occupying range overlapped with an occupying range of the power transmission mechanism 82 in the leftward/rightward direction 9. On the other hand, the cartridge attachment portion 110 has a right end positioned leftward of the left ends of the sheet roll 37 and the holder 81. That is, the occupying range of the cartridge attachment portion 110 is outside of the occupying ranges of the sheet roll 37 and the holder 81 in the leftward/rightward direction 9.

In a state where the cover 16 is at the open position, four of the cartridges 70 are attachable to and detachable from the cartridge attachment portion 110 through the second opening 19. When a residual amount of ink stored in each cartridge 70 is decreased or the ink in the cartridge 70 is used up, a user detaches the empty cartridge 70 from the cartridge attachment portion 110 and attaches a new cartridge 70 filled with full of ink to the cartridge attachment portion 110. Incidentally, the number of the cartridges 70 to be attached to the cartridge attachment portion 110 need not be four.

The cartridge attachment portion 110 is a box-shaped member supported by the left wall 146 of the casing 14 and the left side frame 31 positioned in the internal space 29 of the casing 14. Incidentally, the cartridge attachment portion 110 may be supported by component(s) other than the left side frame 31 and the left wall 146.

The cartridge attachment portion 110 includes: a bottom plate 111; an inner plate 114 extending upward from a rear end of the bottom plate 111; and a pair of side plates 112 extending upward from left end and right end of the bottom plate 111. The cartridge attachment portion 110 also includes three partitioning plates 113 that partition an inner space of the cartridge attachment portion 110 into four individual chambers. Each partitioning plate 113 extends in the frontward/rearward direction 8 and the leftward/rightward direction 9. Left and right ends of each partitioning plate 113 are connected to the respective side plates 112. Hence, the four chambers in the cartridge attachment portion 110 are arrayed in the upward/downward direction 7.

Each of the four cartridges 70 is attachable to and detachable from the corresponding one of the four chambers in the cartridge attachment portion 110. In the present embodiment, a cartridge 70B storing black ink, a cartridge 70Y storing yellow ink, a cartridge 70C storing cyan ink, and a cartridge 70M storing magenta ink are respectively attachable to the chambers in this order from the top to the bottom. The cartridges 70B, 70Y and 70C are supported by the respective partitioning plates 113, and the cartridge 70M is supported by the bottom plate 111 of the cartridge attachment portion 110. In this manner, the cartridge attachment portion 110 is configured to receive the four cartridges 70 (70B, 70Y, 70C and 70M) arrayed with one another in the upward/downward direction 7. Incidentally, the positions of the four cartridges 70B, 70Y, 70C and 70M relative to the four chambers need not be limited to those described above. Further, the four cartridges 70B, 70Y, 70C and 70M may not have the same size as one another. For example, the cartridge 70B may have a size greater than that of each of the remaining cartridges 70Y, 70C and 70M.

Figure 7:
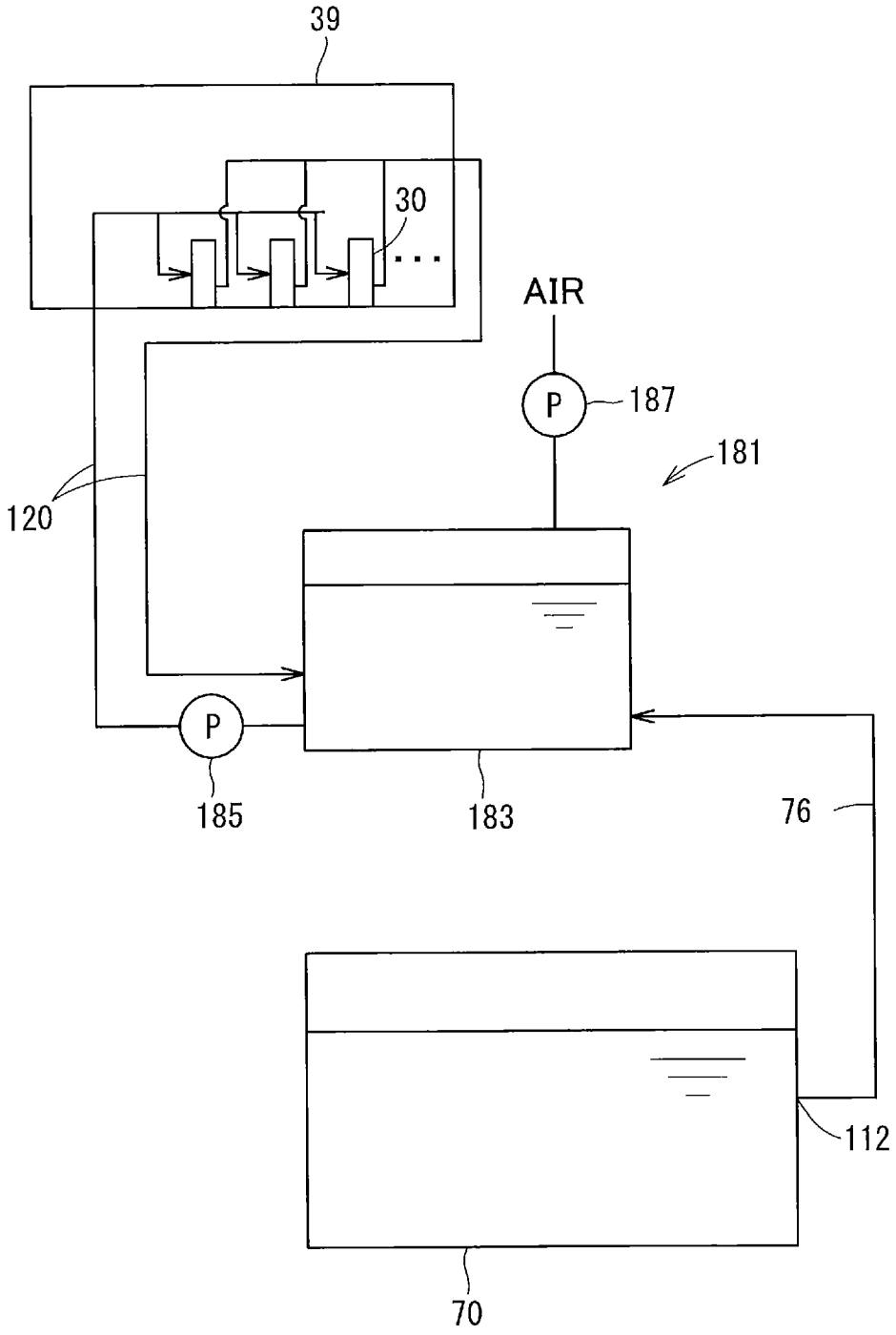
FIG. 7 is a schematic view schematically illustrating an overall configuration of a circulation mechanism 181 provided in the printer 10 according to the embodiment.

As illustrated in FIG. 6, each of the four cartridge 70 includes a connecting portion 121. Further, the inner plate 114 of the cartridge attachment portion 110 includes a plurality of counterpart connecting portions 122 in one-to-one correspondence with the four connecting portions 121. The circulation mechanism 181, the tube 76 and the tubes 120 are provided for each cartridge 70. Each circulation mechanism 181 includes a sub-tank 183 (FIG. 7). Each tube 76 has one end connected to the corresponding counterpart connecting portions 122 (see FIG. 6), and has another end connected to the corresponding sub-tank 183. Each tube 120 has one end connected to the corresponding sub-tank 180, and has another end connected to the head 39. In FIG. 6, only one single circulation mechanism 181 is illustrated for simplicity, and in FIG. 7, only one single cartridge 70, one single circulation mechanism 181, one single tube 76, and two tubes 120 are illustrated for simplicity.

In the attached state of the cartridge 70 to the cartridge attachment portion 110, the connecting portion 121 is connected to the corresponding counterpart connecting portion 122. Hence, ink stored in the cartridge 70 can be supplied to the head 39 through the corresponding tube 79, circulation mechanism 181, and tubes 120.

As illustrated in FIG. 2, the cap 73 is positioned directly below the platen 25 that is at the supporting position. That is, the cap 73 is positioned directly below the sheet passage 22. Further, the cap 73 is positioned rearward of the holder 81 and the sheet roll 37.

The cap 73 is movable in the upward/downward direction 7 upon receipt of driving force from the motor 18. Specifically, the cap 73 is movable in the upward/downward direction 7 between a capping position (indicated by a broken line in FIG. 2) and an uncapping position (indicated by a solid line in FIG. 2).

The cap 73 at the capping position is in close contact with the lower surface of the head 39 to cover the plurality of nozzles 30 from below. The uncapping position is lower than the capping position. The cap 73 at the uncapping position is positioned away from the head 39. At this time, the plurality of nozzles 30 are exposed to the outside without being covered by the cap 73.

Normally, the cap 73 is at the capping position. At this time, the platen 25 is at the retracted position. For performing an image recording operation to the sheet 11, the cap 73 is configured to be moved from the capping position to the uncapping position, and then, the platen 25 is moved from the retracted position to the supporting position. Incidentally, the cap 73 at its uncapping position is positioned lower than the platen 25 at its retracted position. Hence, at the uncapping position, the cap 73 does not hinder the pivotal movement of the platen 25 from the retracted position to the supporting position. Further, the platen 25 at its supporting position is positioned between the head 39 and the cap 73 at its uncapping position in the upward/downward direction 7.

A flexible tube 77 (see FIG. 2) made from resin is also provided in the internal space 29. The tube 77 has one end connected to the cap 73 and another end connected to the waste liquid tank 71 (FIG. 5) attached to the casing 14. In a case where the nozzles 30 eject ink when the cap 73 is at the capping position, the cap 73 receives the ejected ink and the ink received in the cap 73 is discharged to the waste liquid tank 71 through the tube 77.

As illustrated in FIGS. 5 and 6, the waste liquid tank 71 has a shape of rectangular parallelepiped and is configured to store waste ink therein. The waste liquid tank 71 is positioned directly below the cartridge attachment portion 110, and is supported by a frame (not illustrated) of the casing 14. The waste liquid tank 71 is positioned directly above the power transmission mechanism 82. That is, the cartridge attachment portion 110, the waste liquid tank 71, and the power transmission mechanism 82 are arrayed with one another in this order in the upward/downward direction 7.

The ink discharged from the cap 73 is introduced into the waste liquid tank 71 through the tube 77. The waste liquid tank 71 of the present embodiment is a cartridge type container attachable to and detachable from the casing 14.

That is, at the open position of the cover 16, the waste liquid tank 71 is attachable to and detachable from the casing 14 through the second opening 19.

As illustrated in FIG. 2, the heater 26 is positioned above the sheet passage 22, downstream of the recording unit 24 and upstream of the second pair of conveyer rollers 55 in the sheet conveying direction.

The heater 26 is a so-called halogen heater. The heater 26 includes: a halogen lamp 40 configured to irradiate infrared ray; a reflection plate 41; and a heater case 42. The heater case 42 has a shape of generally rectangular parallelepiped whose lower wall is formed with an opening 43 extending in the leftward/rightward direction 9.

The halogen lamp 40 is positioned inside the heater case 42. The halogen lamp 40 has a cylindrical shape elongated in the leftward/rightward direction 9. The reflection plate 41 is positioned in the heater case 42 and above the halogen lamp 40. The reflection plate 41 is formed of a metal plate coated with ceramic film, for example. The reflection plate 41 is curved to provide an arcuate shape in cross section whose center axis is positioned close to the opening 43. Instead of providing the reflection plate 41, the halogen lamp 40 may be coated with ceramic film. Heat released from the halogen lamp 40 and reflected by the reflection plate 41 is irradiated outside of the heater case 42 through the opening 43.

The heater 26 is configured to heat at least one of the sheet 11 positioned below the opening 43 and the ink adhered on the sheet 11. In the present embodiment, the heater 26 is configured to heat both of the sheet 11 and the ink. The ink is fixed to the sheet by heating the ink.

Incidentally, instead of the heater 26, an ultraviolet irradiation device may be available for fixing ink to the sheet 11. In the latter case, the ink contains ultraviolet curing resin. The ink on the sheet 11 is fixed to the sheet 11 by irradiation of infrared ray from the ultraviolet irradiation device.

As illustrated in FIG. 2, the CIS 27 is positioned above the sheet passage 22 and downstream of the heater 26 in the sheet conveying direction. The CIS 27 includes a line sensor configured to read the image on the sheet 11. Specifically, light irradiated from a light source such as an LED is reflected on the sheet 11, and the reflected light is converged on the line sensor by a SELFOC lens (registered trademark). The CIS 27 is configured to output an electric signal in accordance with an intensity of the reflected light received in the line sensor. The CIS 27 has a reading line extending in the leftward/rightward direction 9. The CIS 27 can thus read an image on the sheet 11.

The cutter unit 28 is positioned above the sheet passage 22 and downstream of the CIS 27 in the sheet conveying direction. The cutter unit 28 includes a cutter carriage 46 and a cutter 45 mounted thereon. The cutter carriage 46 is movable in the leftward/rightward direction 9 by a belt driving mechanism (not illustrated). The cutter 45 is provided to traverse the sheet passage 22 in the upward/downward direction 7, and is movable across the sheet passage 22 in accordance with the movement of the cutter carriage 46 in the leftward/rightward direction 9. Hence, the sheet 11 on the sheet passage 22 is cut in the leftward/rightward direction 9.

As illustrated in FIG. 2, the circuit board 17C of the operation panel 17 is positioned above the cutter carriage 46.

Further, as illustrated in FIG. 6, a substrate 130 is positioned in the internal space 29 at a position rearward of the cartridge attachment portion 110 and the power transmission mechanism 82 and leftward of the left side frame 31 (the near side of the left side frame 31 in FIG. 6). That is, the substrate 130 is positioned outward of the left side frame 31 in the leftward/rightward direction 9. The substrate 130 is fixed to the left side frame 31. A computing element functioning as a main controller for controlling operations of the printer 10, a chip functioning as a communication interface, and various connectors are mounted on the substrate 130. The substrate 130 is connected to the head 39, the motor 18, and the operation panel 17 by a flat cable (not illustrated) for electrical communication therewith. Further, the substrate 130 is connected to a power source unit (not illustrated) for receiving electrical power therefrom.

As illustrated in FIG. 6, the circulation mechanism 181 (only one of the circulation mechanisms 181 is illustrated in FIG. 6) is also positioned in the internal space 29 at a position leftward of the left side frame 31 (the near side of the left side frame 31 in FIG. 6). That is, the circulation mechanism 181 is positioned outward of the left side frame 31 in the leftward/rightward direction 9. The circulation mechanism 181 is supported by the left side frame 31. The circulation mechanism 181 is positioned frontward of the substrate 130 and rearward of the cartridge attachment portion 110 and the power transmission mechanism 82. That is, the circulation mechanism 181 and the substrate 130 are positioned side by side in the frontward/rearward direction 8.

As illustrated in FIG. 7, each circulation mechanism 181 includes the sub-tank 183, a first pump 185, and a second pump 187. The circulation mechanism 181 is connected to the corresponding cartridge 70 through the corresponding tube 76, and is connected to the nozzles 30 of the head 39 through the corresponding tubes 120. Each of the tubes 76, 120 is provided with a valve (not illustrated).

Specifically, ink in each cartridge 70 can be supplied to the corresponding sub-tank 183 through the corresponding tube 76. The sub-tank 183 is allowed to communicate with an atmosphere through the second pump 187. Upon actuation of the second pump 187, the interior of the sub-tank 183 becomes negative pressure, so that ink in the corresponding cartridge 70 is introduced into the sub-tank 183. At this time, the tubes 120 are closed to shut off communication between the sub-tank 183 and the nozzles 30. On the other hand, upon actuation of the first pump 185, ink is circulated between the sub-tank 183 and the nozzles 30 of the head 39 through the tubes 120.

[Operational and Technical Advantages of the Embodiment]

According to the present embodiment, the cartridge attachment portion 110 is positioned above the power transmission mechanism 82. Therefore, the casing 14 can be made smaller in size in the leftward/rightward direction 9, compared to a structure where the cartridge attachment portion 110 and the power transmission mechanism 82 are arrayed with each other in the leftward/rightward direction 9.

Further, each cartridge 70 and the holder 81 are inserted into and removed from the casing 14 through the second opening 19 and the first opening 15 both of which are opened at the front surface 141A of the front wall 141. Therefore, replacement of the cartridges 70 and the sheet roll 37 can be performed, even if the printer 10 is placed such that the right wall 145 or the left wall 146 of the casing 14 is set against a wall.

Further, the cartridges 70 and the holder 81 are inserted into and removed from the casing 14 through the second opening 19 and the first opening 15 both of which are opened at the front surface 141A of the front wall 141. Therefore, all replaceable components (such as the cartridges 70 and the sheet roll 37) are accessible in the same direction (from the front side of the casing 14) with regard to the casing 14.

Further, since the cartridges 70 are arrayed in the upward/downward direction 7, increase in size in the leftward/rightward direction 9 of the casing 14 can be restrained, which is in high contrast to a structure where the cartridges 70 are arrayed in the leftward/rightward direction 9.

Further, for exchanging the waste liquid tank 71 in addition to the exchange of the cartridges 70 and the holder 81, a user can approach the waste liquid tank 71 in the same manner as approaching the cartridges 70 and the holder 81 in terms of direction and position.

Further, adhesion of ink onto the cartridge attachment portion 110 and the cartridges 70 can be restrained even if leakage of ink from the waste liquid tank 71 occurs, since the waste liquid tank 71 is positioned below the cartridge attachment portion 110 and cartridges 70.

Further, since the cap 73 is positioned rearward of the holder 81, increase in size in the leftward/rightward direction 9 of the casing 14 can be obviated in comparison with a structure where the cap 73 and the holder 81 are arrayed with each other in the leftward/rightward direction 9.

Further, the pivotal movement of the platen 25 from the supporting position to the retracted position can provide the space for the cap 73 to move from the separated position to the abutment position.

Further, the head 39 is positioned rearward of the occupying range of the sheet roll 37 in the present embodiment. With this structure, even if the cap 73 is positioned directly below the head 39, interference of the cap 73 with the sheet roll 37 can be avoided.

Further, since the head 39 is positioned rearward of the cartridge attachment portion 110, increase in size in the leftward/rightward direction 9 of the casing 14 can be restrained, in contrast to a structure where the head 39 and the cartridge attachment portion 110 are arrayed with each other in the leftward/rightward direction 9.

Further, in the casing 14 according to the embodiment, the heater 26, the CIS 27, the cutter unit 28 and the operation panel 17 are arranged at an idle space positioned frontward of the head 39 and upward of the holder 81. With this structure, the casing 14 can be made compact.

Further, according to the printer 10 of the embodiment, access to the holder 81 can be realized by pulling out the holder attachment portion 90 positioned adjacent to the first opening 15. This structure enables a user to allow access to the holder 81 even if the holder 81 is positioned remote from the first opening 15 inside the casing 14.

Further, the substrate 130 is positioned leftward of the left side frame 31 in the depicted embodiment, while the sheet 11 (the sheet roll 37) is positioned rightward of the left side frame 31. Accordingly, interference between the substrate 130 and the sheet 11 does not occur.

Further, adhesion of ink onto the sheet 11 can be prevented even if ink leakage occurs from the circulation mechanism 181. Further, since the circulation mechanism 181 and the substrate 130 are arrayed with each other in the frontward/rearward direction 8, downsizing in the leftward/rightward direction 9 of the casing 14 can be attained, compared to a structure where the circulation mechanism 181 and the substrate 130 are arrayed with each other in the leftward/rightward direction 9.

[Variations and Modifications]

In the above-described embodiment, the sheet passage 22, the holder 81, the first sheet feed roller 20, the second sheet feed roller 21, the first pair of conveyer rollers 54, the second pair of conveyer rollers 55, the platen 25, the heater 26, the CIS 27, and the cutter unit 28 are positioned at the right portion of the internal space 29 of the casing 14, whereas the power transmission mechanism 82, the cartridge attachment portion 110, the cartridges 70, and the waste liquid tank 71 are positioned at the left portion of the internal space 29 of the casing 14. However, this positional relationship with respect to the leftward/rightward direction 9 may be reversed.

In the above-described embodiment, the cartridge attachment portion 110 is configured to receive the four cartridges 70 arrayed in the upward/downward direction 7. However, the four cartridges 70 may be arrayed in the leftward/rightward direction 9 in the cartridge attachment portion 110.

Figure 8:
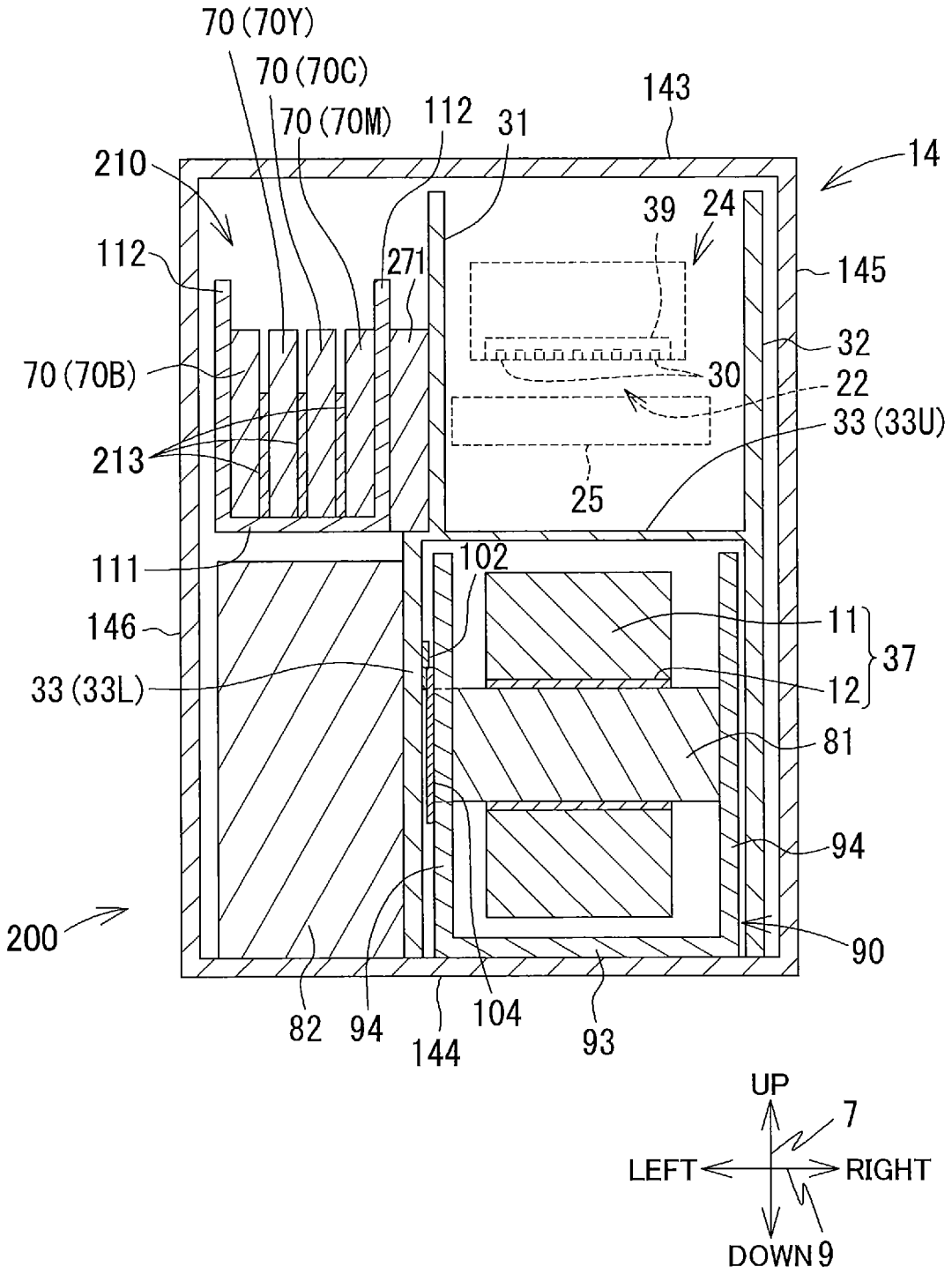
FIG. 8 is a cross-sectional view of a printer 200 according to a first modification to the embodiment taken along a line corresponding to the line V-V in FIG. 1.

For example, FIG. 8 illustrates a printer 200 including a cartridge attachment portion 210 according to a first modification to the embodiment. The cartridge attachment portion 210 includes three partitioning plate 213 each extending in the upward/downward direction 7, instead of the partitioning plates 113. In this cartridge attachment portion 210, the cartridges 70 are accommodated such that the cartridges 70 are arrayed with one another in the leftward/rightward direction 9, rather than in the upward/downward direction 7.

Further, in the described embodiment, the waste liquid tank 71 has a length in the leftward/rightward direction 9 greater than the length in the upward/downward direction 7. That is, the leftward/rightward direction 9 is the longitudinal direction of the waste liquid tank 71. However, referring to FIG. 8, a waste liquid tank 271 according to the first modification has a length in the upward/downward direction 7 greater than a length in the leftward/rightward direction 9. That is, the upward/downward direction 7 is the longitudinal direction of the waste liquid tank 271.

In the first modification illustrated in FIG. 8, the waste liquid tank 271 accommodated in the casing 14 is elongated in the upward/downward direction 7. With this arrangement, a user can easily recognize that an amount of the waste ink stored in the waste liquid tank 271 reaches a full capacity.

In the above-described embodiment, the circuit board 17C of the operation panel 17, the heater 26, the CIS 27, and the cutter unit 28 are positioned in the internal space 29 of the casing 14 at the position frontward of the head 39 and above the holder 81. In addition, a collecting member 44 indicated by a broken line in FIG. 2 may also be positioned in the internal space 29 at the position frontward of the head 39 and above the holder 81. The collecting member 44 is configured to collect ink mist generated from the ink ejected from the head 39 and to discharge the ink mist to the outside. For example, the collecting member 44 includes a duct indicated by the broken line in FIG. 2 and a suction pump (not illustrated) connected to the duct. A through-hole (not illustrated) may be formed in the upper wall 143 of the casing 14, and the duct may be connected to the through-hole. Upon actuation of the suction pump, the ink mist floating in the space is introduced into the duct, and is discharged outside through the through-hole.

Incidentally, all of the operation panel 17, the heater 26, the CIS 27, the cutter unit 28, and the collecting member 44 need not be positioned in the space frontward of the head 39 and above the holder 81. For example, the printer 10 may not include the CIS 27 and the collecting member 44. In the latter case, the operation panel 17, the heater 26, and the cutter unit 28 may be positioned in the space frontward of the head 39 and above the holder 81.

In the above-described embodiment, each of the cartridges 70 is detached from the cartridge attachment portion 110 when the amount of ink stored in the cartridge 70 is reduced or the ink is used up, and a new cartridge 70 filled with full of ink is attached to the cartridge attachment portion 110. That is, ink is supplied to the printer 10 by exchanging the cartridge 70 with the new cartridge 70. However, ink replenishment may be performed by other way. For example, ink inlets may be provided at the casing 14 (for example, at the front wall 141), so that ink may be replenished into each cartridge 70 through the corresponding ink inlet.

Figure 9:
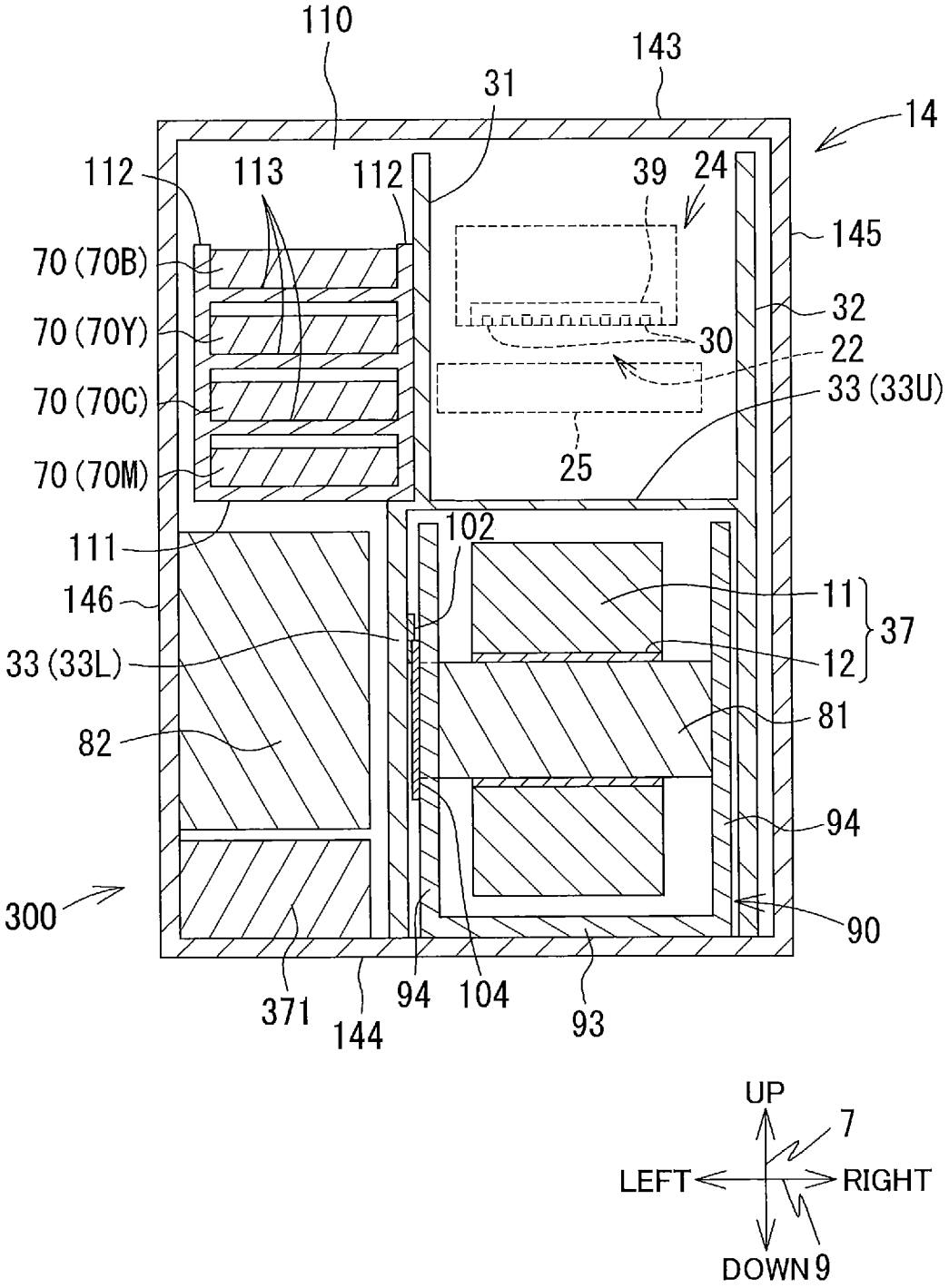
FIG. 9 is a cross-sectional view of a printer 300 according to a second modification to the embodiment taken along a line corresponding to the line V-V in FIG. 1.

In the above-described embodiment, the waste liquid tank 71 is positioned above the power transmission mechanism 82. However, the waste liquid tank 71 may be positioned below the power transmission mechanism 82. For example, FIG. 9 illustrates a printer 300 according to a second modification to the embodiment. In the second modification, a waste liquid tank 371 is supported by the lower wall 144 of the casing 14 at a position below the power transmission mechanism 82. With this structure, even if ink is leaked from the waste liquid tank 71, adhesion of the leaked ink to the power transmission mechanism 82 is less likely to occur.

In the above-described embodiment, the sheet roll 37 is positioned frontward of the head 39. However, the sheet roll 37 may be positioned rearward of the head 39. In other words, the head 39 may be positioned frontward of the occupying range of the sheet roll 37.

In the above-described embodiment, the printer 10 includes the holder attachment portion 90 configured to be pulled out relative to the casing 14, and the holder 81 is positioned inside the holder attachment portion 90. However, the printer 10 may not include the holder attachment portion 90. In the latter case, the first opening 15 may be opened and closed by a cover similar to the cover 16 for the second opening 19. Alternatively, the first opening 15 may be opened and closed by a single cover which is also configured to open and close the second opening 19.

In such modifications, the holder 81 may be supported by the casing 14, and the holder 81 and the sheet roll 37 attached to the holder 81 may be attached to and detached from the casing 14 through the first opening 15. Further alternatively, a side opening may be formed in the right wall 145 of the casing 14, and a side cover may be provided for opening and closing the side opening. In this modification, the holder 81 and the sheet roll 37 attached to the holder 81 may be attached to and detached from the casing 14 through the side opening by opening the side cover.

In the above-described embodiment, line-head type inkjet recording system is employed for recording an image on the sheet 11. Alternatively, a serial type inkjet recording system is available. In the latter case, the recording unit 24 may include a carriage having the head 39 mounted thereon, and ink is ejected from the head 39 as the carriage moves in the leftward/rightward direction 9 to form an image on the sheet 11.

In the above-described embodiment, the ink stored in the cartridge 70 is exemplified as liquid. However, a pretreatment liquid to be ejected to the sheet 11 prior to ejection of ink or water for cleaning the head 39 can be the liquid of the disclosure.

While the description has been made in detail with reference to the embodiments, it would be apparent to those skilled in the art that many modifications and variations may be made thereto.

[Remarks]

The printer 10, 200, 300 is an example of a liquid ejection device. The casing 14, 214 is an example of a casing. The cartridge attachment portion 110, 310 is an example of a cartridge attachment portion. The holder 81 is an example of a holder. The sheet roll 37 is an example of a sheet roll. The power transmission mechanism 82 is an example of a power transmission mechanism. The first pair of conveyer rollers 54 and the second pair of conveyer rollers 55 are an example of a conveying mechanism. The head 39 is an example of a head. The cap 73 is an example of a maintenance unit. The first opening 15 and the second opening 19 are an example of an opening. The waste liquid tank 71, 371 is an example of a waste liquid storage portion. The operation panel 17 is an example of a display unit. The collecting member 44 is an example of a collecting member. The transmission gear 102 is an example of a transmission gear, and the follower gear 104 is an example of a follower gear. The holder attachment portion 90 is an example of a holder attachment portion. The substrate 130 is an example of a substrate. The circulation mechanism 181 is an example of a supply unit.

What is claimed is:

1. A liquid ejection device comprising:

a casing having a front surface in which a discharge opening and an opening are formed, the casing defining therein an internal space;

a holder configured to be accommodated in the internal space and configured to rotatably support a sheet roll including a continuous sheet, the holder supporting the sheet roll being rotatable about a rotation axis extending in a leftward/rightward direction perpendicular to a frontward/rearward direction and an upward/downward direction;

a power transmission mechanism positioned beside the holder in the leftward/rightward direction and configured to transmit rotational driving force to the holder;

a cartridge attachment portion positioned above the power transmission mechanism and configured to receive a cartridge storing liquid therein;

a conveying mechanism positioned in the internal space and configured to convey the continuous sheet to the discharge opening; and a head positioned in the internal space and configured to eject the liquid to the continuous sheet, wherein an occupying range of the cartridge attachment portion is overlapped with an occupying range of the power transmission mechanism and outside of an occupying range of the sheet roll and the holder in the leftward/rightward direction, and wherein the cartridge and the holder are attachable to and detachable from the casing through the opening.

2. The liquid ejection device according to claim 1, wherein the opening comprises:

a first opening through which the holder is attachable to and detachable from the casing; and a second opening through which the cartridge is attachable to and detachable from the casing.

3. The liquid ejection device according to claim 1, wherein the cartridge attachment portion is configured to receive a plurality of the cartridges with the plurality of the cartridges arrayed in the upward/downward direction.

4. The liquid ejection device according to claim 1, wherein the cartridge attachment portion is configured to receive a plurality of the cartridges with the plurality of the cartridges arrayed in the leftward/rightward direction.

5. The liquid ejection device according to claim 1, further comprising a waste liquid storage portion configured to be accommodated in the internal space, the waste liquid storage portion being attachable to and detachable from the casing through the opening, and wherein the power transmission mechanism, the waste liquid storage portion, and the cartridge attachment portion are arrayed with one another in the upward/downward direction when the waste liquid storage portion is accommodated in the casing.

6. The liquid ejection device according to claim 5, wherein the waste liquid storage portion is positioned below the cartridge attachment portion when accommodated in the casing.

7. The liquid ejection device according to claim 5, wherein the waste liquid storage portion is positioned below the power transmission mechanism when accommodated in the casing.

8. The liquid ejection device according to claim 1, further comprising a waste liquid storage portion configured to be positioned in the internal space, wherein the waste liquid storage portion is elongated in the upward/downward direction.

9. The liquid ejection device according to claim 1, further comprising:

a sheet passage configured to convey the continuous sheet therealong; and a maintenance unit positioned in the internal space and below the sheet passage, the maintenance unit being movable between an abutment position where the maintenance unit is in abutment with the head to receive the liquid ejected from the head, and a separated position where the maintenance unit is separated away from the head, the separated position being below the abutment position.

10. The liquid ejection device according to claim 9, wherein the maintenance unit is positioned rearward of the holder in the internal space.

11. The liquid ejection device according to claim 9, further comprising a platen pivotally movable between a supporting position and a retracted position retracted from the supporting position, the platen at the supporting position being positioned between the head and the maintenance unit at the separated position for supporting the continuous sheet.

12. The liquid ejection device according to claim 1, wherein the head is positioned beside an occupying range of the sheet roll in the frontward/rearward direction.

13. The liquid ejection device according to claim 1, wherein the head is positioned rearward of the cartridge attachment portion in the internal space.

14. The liquid ejection device according to claim 1, wherein the liquid is ink, the liquid ejection device further comprising:

a fixing device configured to fix an image of the ink to the continuous sheet;

an image reader configured to read the image on the continuous sheet; and a cutter configured to cut the continuous sheet, wherein at least one of the fixing device, the image reader and the cutter is positioned frontward of the head and above the holder.

15. The liquid ejection device according to claim 1, further comprising a collecting member configured to collect ink mist near the head, the collecting member being positioned frontward of the head and above the holder.

16. The liquid ejection device according to claim 1, further comprising a display unit comprising a display screen, the display unit being positioned frontward of the head and above the holder, the display screen being provided on the front surface and exposed to an outside of the casing.

17. The liquid ejection device according to claim 1, wherein the power transmission mechanism comprises a transmission gear having a rotation axis, wherein the holder comprises a follower gear meshingly engageable with the transmission gear, the follower gear being rotatable about a rotation axis coincident with the rotation axis of the holder when the holder is accommodated in the casing, and wherein the rotation axis of the transmission gear is positioned rearward of the rotation axis of the follower gear.

18. The liquid ejection device according to claim 1, further comprising a holder attachment portion configured to receive the holder and configured to be pulled out relative to the casing through the opening, the holder attachment portion having a portion positioned adjacent to the opening when attached to the casing.

19. The liquid ejection device according to claim 1, further comprising a pair of side frames positioned in the internal space and spaced away from each other in the leftward/rightward direction, wherein the holder and the head are positioned between the pair of side frames in the leftward/rightward direction.

20. The liquid ejection device according to claim 19, further comprising a substrate positioned in the internal space and outside of the pair of side frames, the substrate being mounted with a main controller configured to control operations of the liquid ejection device.

21. The liquid ejection device according to claim 20, further comprising a supply unit positioned in the internal space and configured to supply the liquid from the cartridge attached to the cartridge attachment portion to the head, the supply unit being positioned outside of the pair of side frame, the supply unit and the substrate being arrayed with each other in the frontward/rearward direction.

* * * * *